US006712180B2

(12) United States Patent
Levy

(10) Patent No.: US 6,712,180 B2
(45) Date of Patent: Mar. 30, 2004

(54) HEIGHT ADJUSTABLE SAWHORSE

(75) Inventor: Roni Levy, Tel Aviv (IL)

(73) Assignee: Zag Industries Ltd., Rosh Ha'ayin (IL)

( * ) Notice: Subject to any disclaimer, the term of this patent is extended or adjusted under 35 U.S.C. 154(b) by 0 days.

(21) Appl. No.: 10/086,113

(22) Filed: Mar. 1, 2002

(65) Prior Publication Data

US 2002/0125072 A1 Sep. 12, 2002

(51) Int. Cl.[7] ..... E04G 1/34; E04G 1/32
(52) U.S. Cl. ..... 182/153; 182/225
(58) Field of Search ..... 182/153, 151, 182/155, 181.1, 224, 225, 186.1, 186.2, 186.5, 182.4, 182.5, 165, 22–26, 163; D67/25; D25/64, 65

(56) References Cited

U.S. PATENT DOCUMENTS 2,324,196 A * 7/1943 Crozier ..... 182/225 X
4,113,056 A * 9/1978 DeLorenzo ..... 182/153
4,289,215 A * 9/1981 Robinson ..... 182/182.4 X
4,298,093 A * 11/1981 Wing ..... 182/153
4,782,917 A * 11/1988 Schulz ..... 182/225 X
4,877,109 A * 10/1989 Welch et al. ..... 182/225 X
5,351,785 A * 10/1994 DuRapau ..... 182/153
6,164,413 A 12/2000 Sagol
6,209,683 B1 4/2001 Holtz
6,298,946 B1 10/2001 Yemini et al.
6,305,498 B1 10/2001 Itzkovitch
6,488,119 B1 * 12/2002 DuRapau et al. ..... 182/153

* cited by examiner

*Primary Examiner*—Hugh B. Thompson
(74) *Attorney, Agent, or Firm*—Pillsbury Winthrop LLP

(57) ABSTRACT

A sawhorse includes an elongated workpiece supporting structure and a pair of leg assemblies joined to the workpiece supporting structure, which enables the leg assemblies to be moved between a folded position for storage and transportation purposes and an operative position. Connecting structure connects the leg assemblies to retain the leg assemblies in the operative position thereof and to allow movement of the leg assemblies between the operative and folded positions thereof. Each leg assembly includes a pair of separate lower leg members and is mounted for independent movement in a generally vertical direction and adjusted to a plurality of different positions with respect to the associated leg assembly and the connecting structure while the pair of the leg assemblies are retained in the operative position thereof by the connecting structure. A releasable locking member for each leg member is mounted in the connecting structure for movement between a releasing position and a locking position.

18 Claims, 8 Drawing Sheets

HEIGHT ADJUSTABLE SAWHORSE

BACKGROUND OF THE INVENTION

1. Field of the Invention

The present invention relates to a sawhorse and, more particularly, to a height adjustable sawhorse. The present invention further relates to a sawhorse having independently moving leg members that allow height adjustment to be readily and easily accomplished.

2. Description of the Related Art

A sawhorse is a movable frame or trestle for supporting wood or another workpiece while it is being sawed or for supporting plates to provide working spaces. A sawhorse typically includes two leg members hingedly connected at the tops thereof and a spread limiting mechanism which defines the working spread at their bottom.

Traditionally sawhorses were made of wood or metal, however, following the technological progress of the plastic industry, sawhorses are nowadays also available from plastic materials.

For whatever purpose it is employed, it is advantageous for a sawhorse to be adjustable in height because it enables users of different heights to adjust the height of the sawhorse to be most comfortable for them. Sawhorses capable of height adjustment can be used in a wider variety of applications than sawhorses without this capability.

Prior art sawhorses are known which are height adjustable. Such devices have extendible/retractable extensions housed by the lower ends of their leg members. One such device is shown in U.S. Pat. No. 6,164,413. This device suffers a limitation because the process of adjusting the height is highly demanding. It requires a user to both adjust individual vertically-adjustable extensions in each sawhorse and secure each vertically-adjustable extension with a respective locking pin during height adjustment all the while holding the vertically-adjustable extension in the adjusted position.

It is an object of the invention to provide an improved adjustable sawhorse.

SUMMARY OF THE INVENTION

According to one aspect of the present invention there is provided a sawhorse comprising an elongated workpiece supporting structure and a pair of leg assemblies. The pair of leg assemblies supports the workpiece supporting structure. Said pair of leg assemblies is movable between a folded position for storage and transportation purposes and an operative position. Connecting structure connects with the leg assemblies below the workpiece supporting structure. The connecting structure is constructed and arranged to retain the leg assemblies in the operative position thereof and to allow movement of the leg assemblies between the operative and folded positions thereof. Each leg assembly includes a pair of separate lower leg members having lower portions. The lower portions are constructed and arranged to engage a horizontal support surface for the sawhorse when the pair of lower leg assemblies is retained in the operative position by the connecting structure thereof. This enables the workpiece supporting structure to be supported at a predetermined height above the horizontal support surface. Each of the lower leg assemblies is mounted for independent movement in a generally vertical direction and can be adjusted to a plurality of different positions with respect to the associated leg assembly and the connecting structure while the pair of the leg assemblies are retained in the operative position thereof by the connecting structure. A releasable locking member for each leg member is mounted in the connecting structure for movement between a releasing position and a locking position. In the releasing position, the releasable locking member is operable to release the associated leg member from movement into a selected one of the plurality of adjusted positions thereof. In the locking position, the releasable locking member is operable to lock the associated leg member within the adjusted position selected.

In another embodiment of the invention, the releasable locking member is spring biased into the locking position thereof for movement between the releasing and locking positions.

BRIEF DESCRIPTION OF THE DRAWINGS

The invention herein described, by way of example only, with reference to the accompanying drawings in which like reference numerals designate like elements and wherein.

DETAILED DESCRIPTION OF EMBODIMENTS OF THE INVENTION

The present invention is directed to a height adjustable sawhorse which can be height adjusted for different users and/or applications. The present invention is further directed to a sawhorse having independently moving leg members that allow height adjustment to be readily and easily accomplished even while the sawhorse is in an operative position.

The principles and operation of a sawhorse according to the present invention may be better understood with reference to the drawings and accompanying descriptions.

Figure 1:
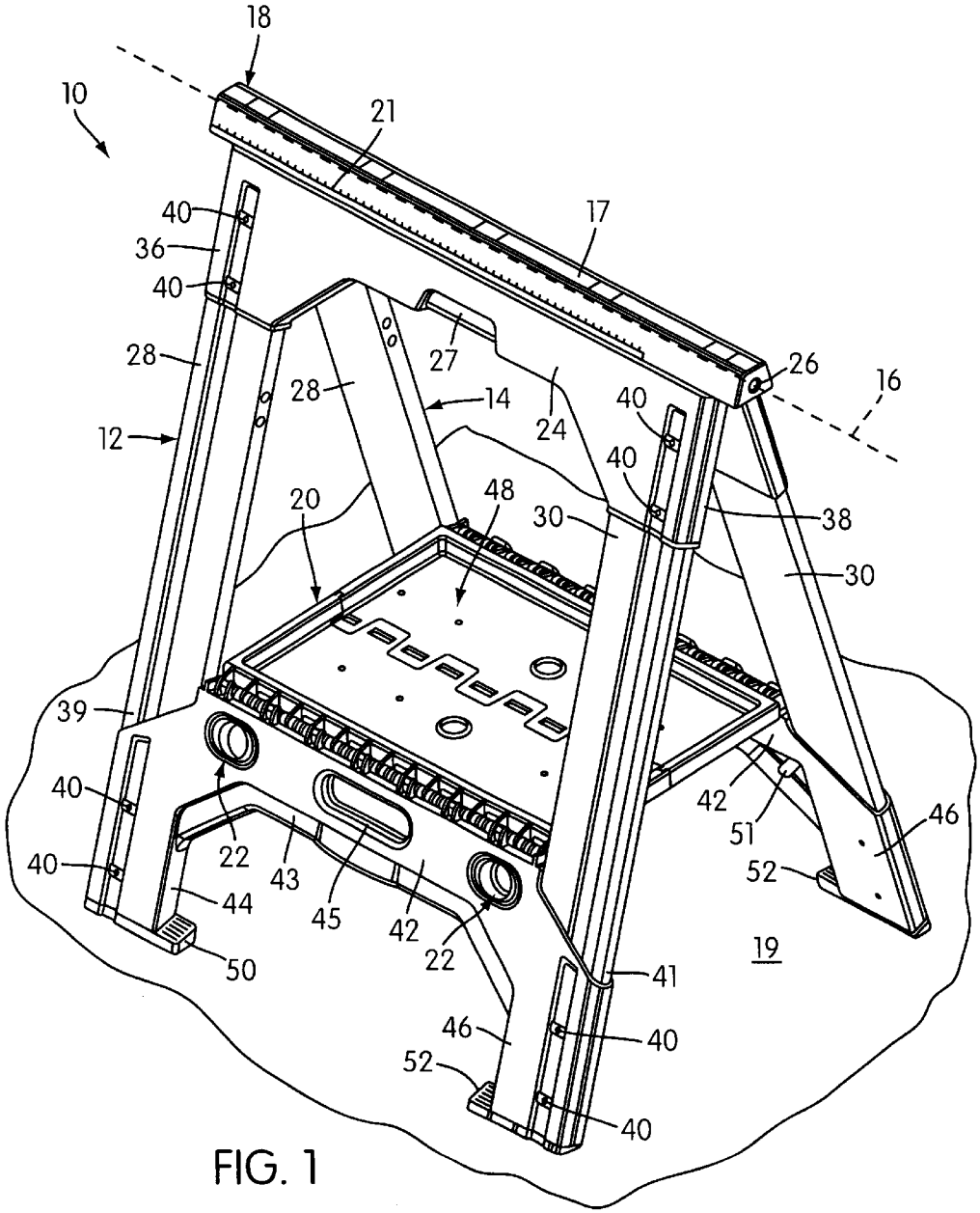
FIG. 1 is a perspective view of a height adjustable sawhorse according to the principles of the present invention shown in a height retracted position.
Figure 2:
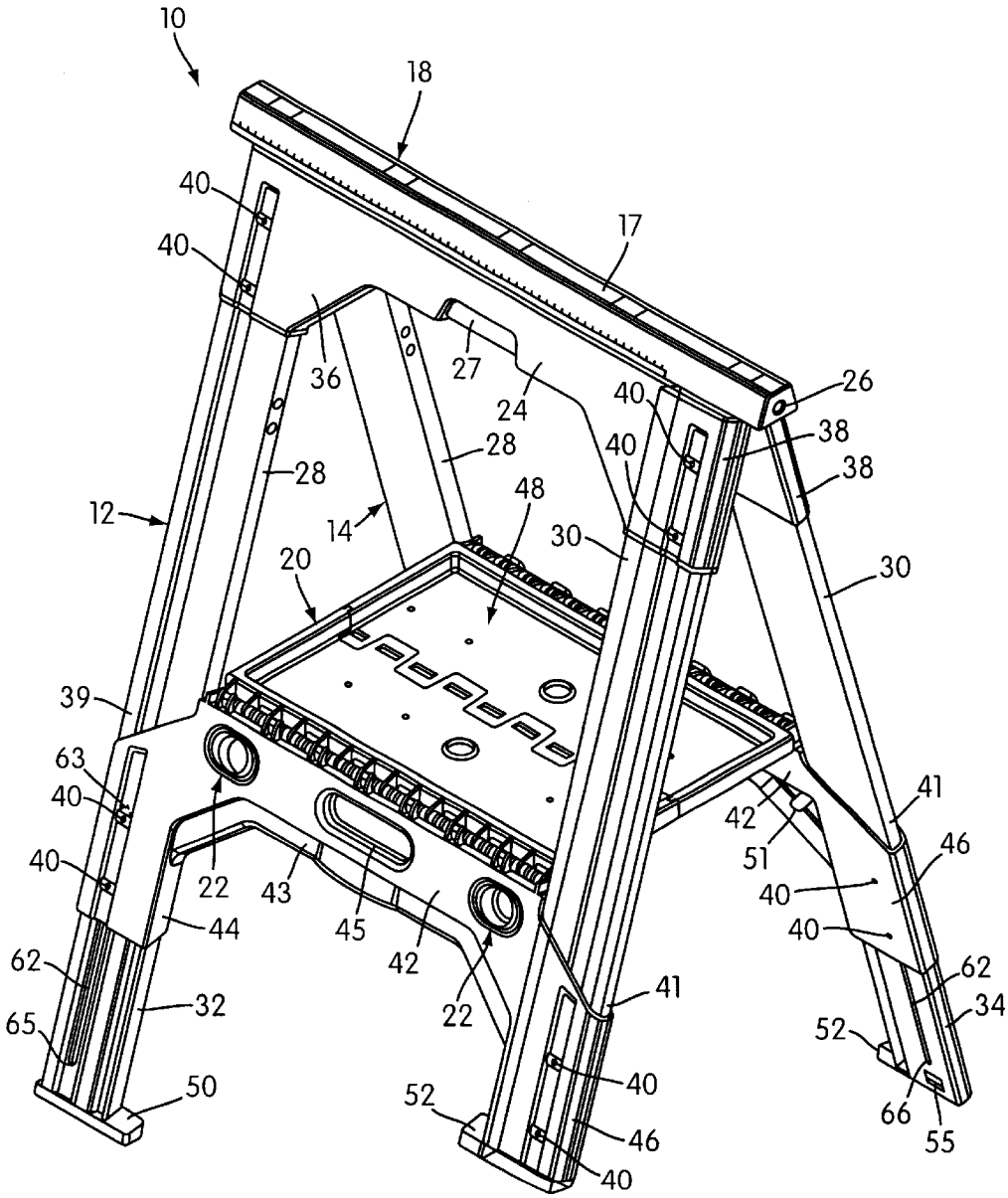
FIG. 2 is a second perspective view of the sawhorse of FIG. 1, two leg members of which are shown in a deployed (vertically extended) position.
Figure 3:
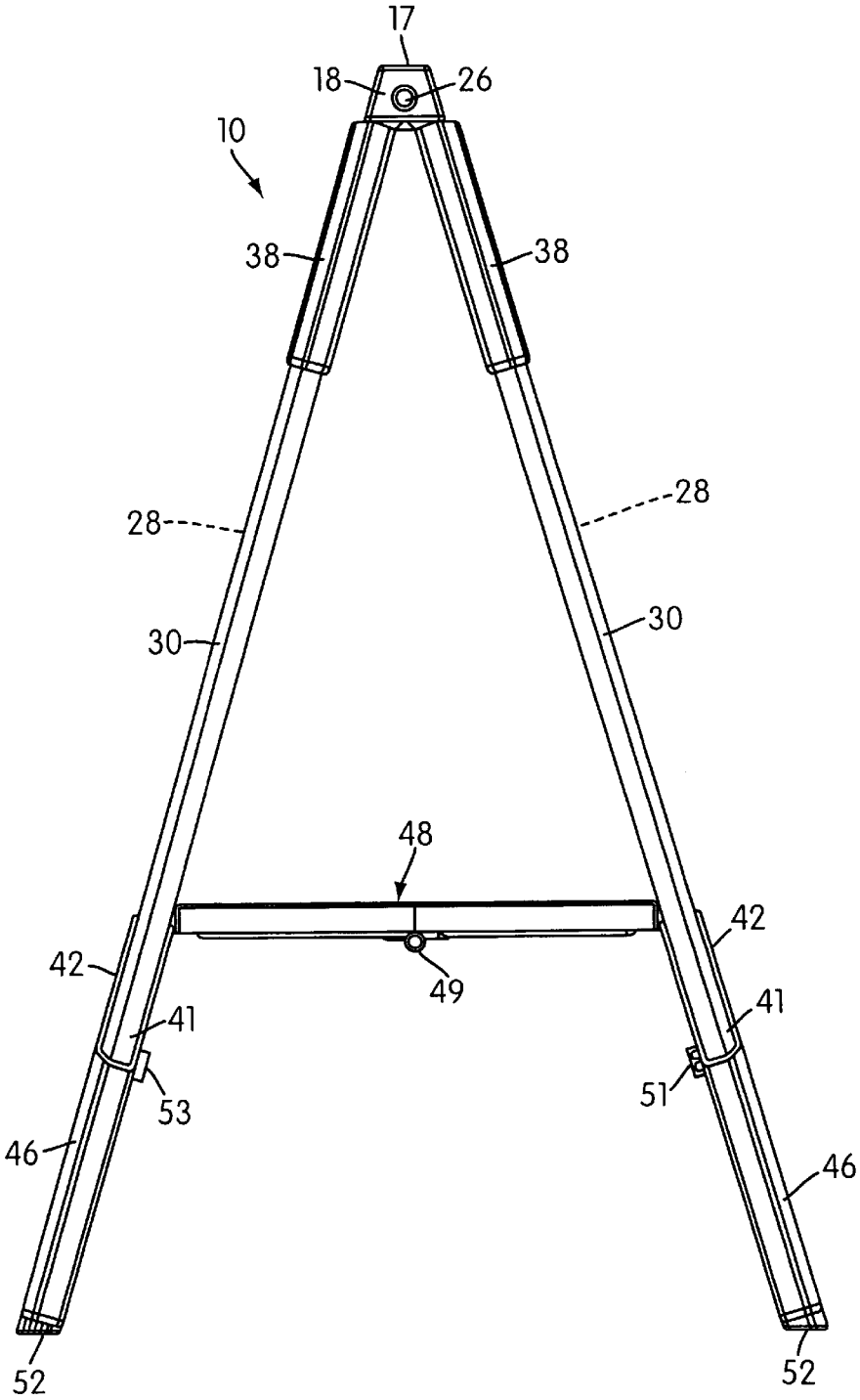
FIG. 3 is a side view of the height adjustable sawhorse of FIG. 1 in the operative position.

Referring now to the drawings, FIGS. 1–8 illustrate one embodiment of a sawhorse, generally indicated at 10, according to the principles of the present invention. The sawhorse 10 includes a pair of leg assemblies 12, 14 that are pivotally connected at their upper ends along a pivot axis 16. The leg assemblies 12, 14 are pivotally connected to be moved between a folded position for storage and transportation purposes (FIG. 4) and an operative position (FIGS. 1–3). An elongated workpiece supporting structure 18 having an upwardly facing workpiece supporting surface 17 is located generally at the upper ends of the leg assemblies 12, 14 and is supported at a predetermined height above a horizontal support surface 19 for the sawhorse 10. The workpiece supporting structure 18 may include indicia 21, such as measurement indicia, printed or formed thereon.

Connecting structure 20 is connected with the leg assemblies 12, 14 below the workpiece supporting structure 18. The connecting structure 20 is constructed and arranged to retain the leg assemblies 12, 14 in the operative position thereof and to allow movement of the leg assemblies 12, 14 between the operative and folded positions thereof. The connecting structure 20 includes a releasable locking member, generally indicated at 22, operable to allow movement between a releasing position and a locking position to at least partially control height adjustment of the workpiece supporting structure 18, as will be described in further detail below.

The leg assemblies 12, 14 may be substantially identical in construction and operation and accordingly, a description of the leg assembly 12 will suffice for an understanding of both leg assemblies 12, 14. The leg assemblies 12, 14 can be formed of the same construction such that only one die or mold can be used to manufacture both leg assemblies 12, 14. Accordingly, like reference numerals designate similar elements of the leg assemblies 12, 14.

The leg assembly 12 includes an upper connecting member 24 that extends along the workpiece supporting structure 18 and may be pivotally connected thereto, for example, by pivot rod 26. Other pivot mechanisms or hinges can be employed as well, such as that disclosed in U.S. Pat. No. 6,305,498, the contents of which are hereby incorporated by reference in its entirety. The upper connecting member 24, which may be formed of plastic, for example, may further include a manually engageable handle 27 for storage and transporting purposes when the sawhorse 10 is in its folded position or for assisting in the height adjustment of the workpiece supporting structure 18. Alternatively, the upper connecting member 24 can be formed of metal or any other suitably rigid material.

The leg assembly 12 further includes a pair of upper leg members 28,30 spaced from one another by the upper connecting member 24 and a pair of lower leg members 32, 34 (FIG. 2) associated with respective upper leg members 28, 30. The upper leg members 28, 30 and the lower leg members 32, 34 can each be formed of metal, plastic or another suitably rigid material. However, it may be preferable for the upper and lower leg members 28, 30, 32, 34 to be formed of a relatively strong and light weight material, such as extruded aluminum. It may also be preferable for the lower leg members 32, 34 to be formed of an extruded or molded polymer material.

The upper connecting member 24 is of elongated hollow cross-sectional configuration sized with respect to the upper leg members 28, 30. The upper leg members 28, 30 are received in respective downwardly extending end portions 36, 38 of the upper connecting structure 24. The upper leg members 28, 30 are fixedly secured to the downwardly extending end portions 36, 38 with a plurality of fasteners 40 so to extend generally downward therefrom when the leg assemblies 12, 14 are in the operative position thereof. The fasteners 40 may be, for example, rivets, screws, bolts or some other fastening device capable of fixedly securing the downwardly extending end portions 36, 38 of the upper connecting structure 24 to the upper leg members 28, 30.

A tool carrier member (not shown) could be provided on an outside surface of the upper connecting structure 24 and attached thereto via the fasteners 40, for example. An example of such a tool carrier member is shown in U.S. Pat. No. 6,305,498, incorporated by reference above.

The connecting structure 20 includes a lower connecting member 42 associated with each leg assembly 12, 14 that is connected to lower portions 39, 41 of the upper leg members 28, 30 thereof. The lower connecting members 42 each have downwardly extending portions 44, 46, which are of elongated hollow cross-sectional configuration sized with respect to the upper leg members 28, 30, so as to receive therein the lower portions 39, 41 of the upper leg members 28, 30. The lower portions 39, 41 of the upper leg members 28, 30 extend through interiors of the downwardly extending portions 44, 46, respectively, and are fixedly secured thereto with a plurality of fasteners, such as the fasteners 40, for example. A cross brace 43 extends from the downwardly extending portion 44, along the underside of the lower connecting member 42 and to the downwardly extending portion 46 to support the leg assemblies 12, 14. An opening can be formed through the lower connecting member 42 to provide a handle portion 45 for manual engagement or gripping by a user. It is contemplated that the connecting structure 20 may be formed of any suitable material, such as polymer or metallic material. It may be preferable, however, for the connecting structure 20 to be formed by molding a polymer material, for example.

FIGS. 2 and 3 show a foldable tray assembly 48 that can be pivotally connected between the lower connecting members 42 with a hinge structure 49 (FIG. 3). The foldable tray assembly 48 is associated with the leg assemblies 12, 14 such that movement of the sawhorse 10 between its folded and operative positions moves the foldable tray assembly 48 between an inoperative, folded position and an operative limiting position. In the operative limiting position, as shown in FIG. 3, the foldable tray assembly 48 acts both as a shelf and to limit the operative spread of the leg assemblies 12, 14 in the operative position thereof. In other words, when the foldable tray assembly 48 is in its operative limiting position, the foldable tray assembly 48 limits the outward movement of the leg assemblies 12, 14 in their opening direction. One example of such a foldable tray assembly is shown in U.S. Pat. No. 6,298,946, the contents of which are hereby incorporated by reference in their entirety.

Figure 4:
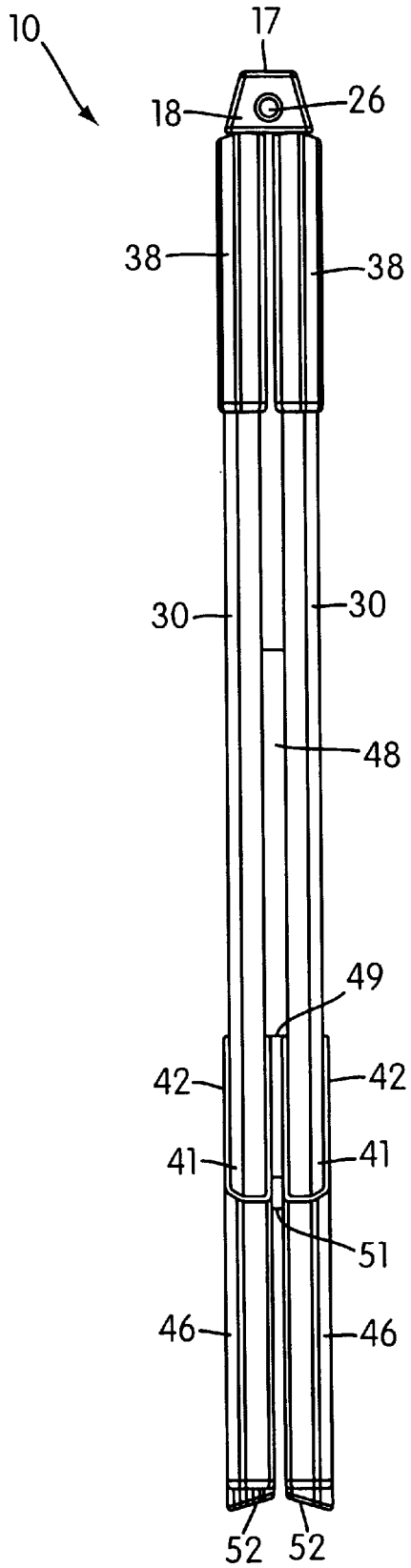
FIG. 4 is a side view of the height adjustable sawhorse of FIG. 1 in the folded, closed position.
Figure 5:
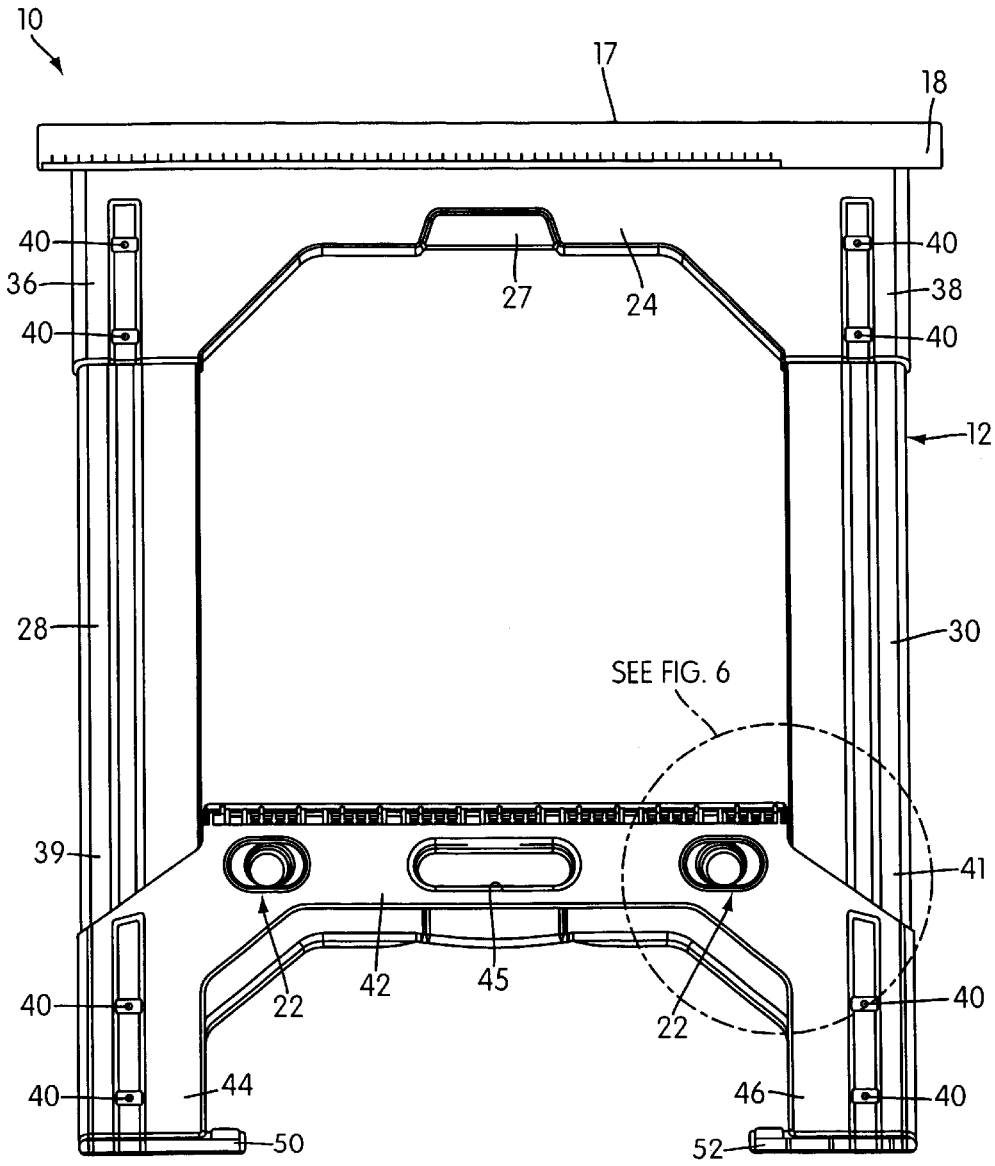
FIG. 5 is a front view of the height adjustable sawhorse of FIG. 1 in the operative position.

As best shown in FIG. 3, the lower connecting members 42 are configured to secure the sawhorse 10 in the folded position. More particularly, each lower connecting member 42 has a bayonet pin portion 51 and a barrel portion 53 extending inwardly from the cross brace 43 at opposite ends thereof. As illustrated, each bayonet pin 51 engages the associated barrel portion 53 upon convergence of the leg assemblies 12, 14 when the leg assemblies 12, 14 are moved into the folded position, as shown in FIG. 4. A press fit between the bayonet pins 51 and the associated barrel portions 53 can retain the leg assemblies 12, 14 in the folded position for storage or transportation purposes.

Another option (not shown) for retaining the leg assemblies 12, 14 in the folded position might be to include a hook-and-eyelet latch. The sawhorse might have one or more such hook-and-eyelet latches. One leg assembly, e.g. 12, may have a hook member extending toward the other leg assembly, which may have an eyelet member that the hook member engages when the sawhorse is in the folded position.

Figure 7:
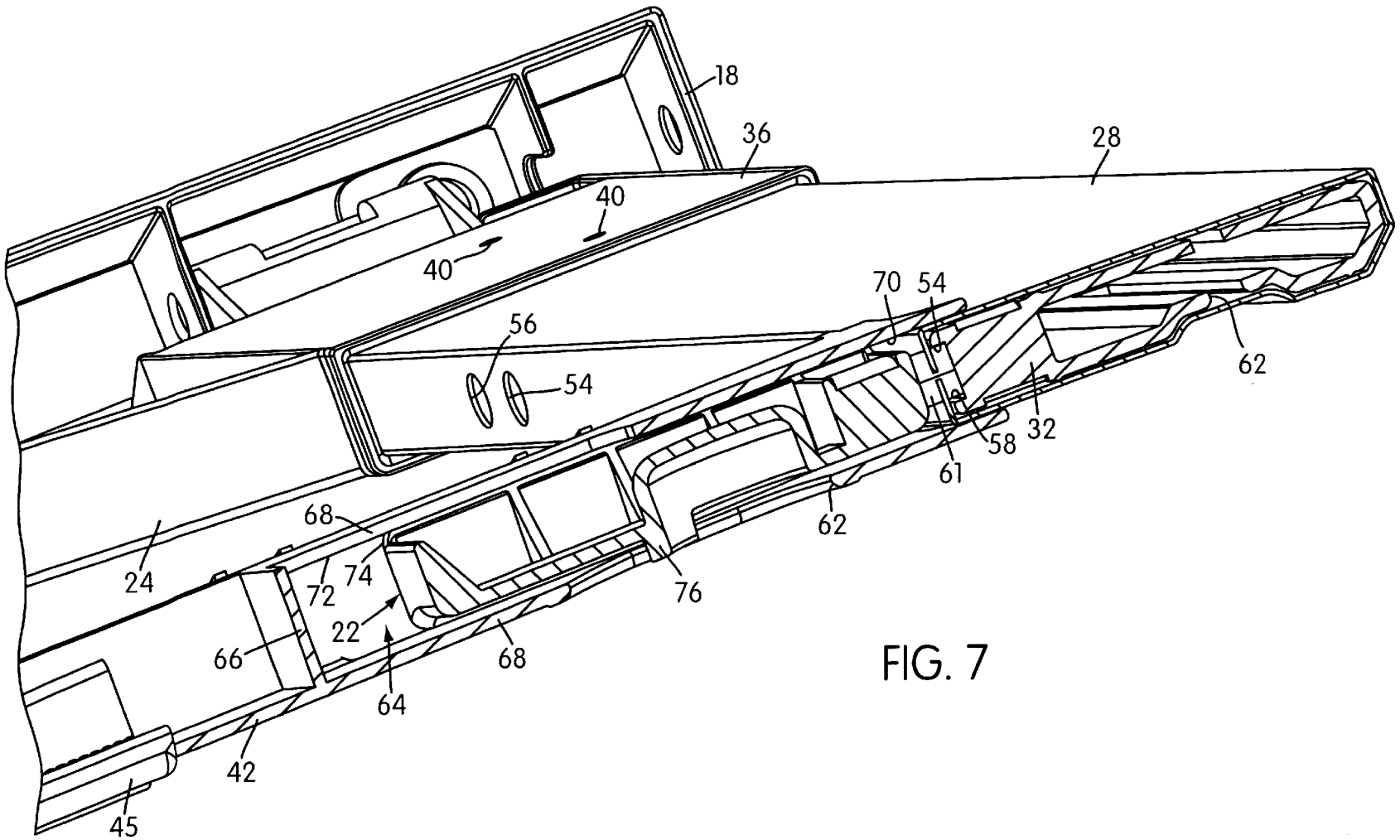
FIG. 7 is a cross-sectional view of the height adjustable sawhorse taken through line 7—7 of FIG. 1 shown a releasable locking member in its locking position.
Figure 8:
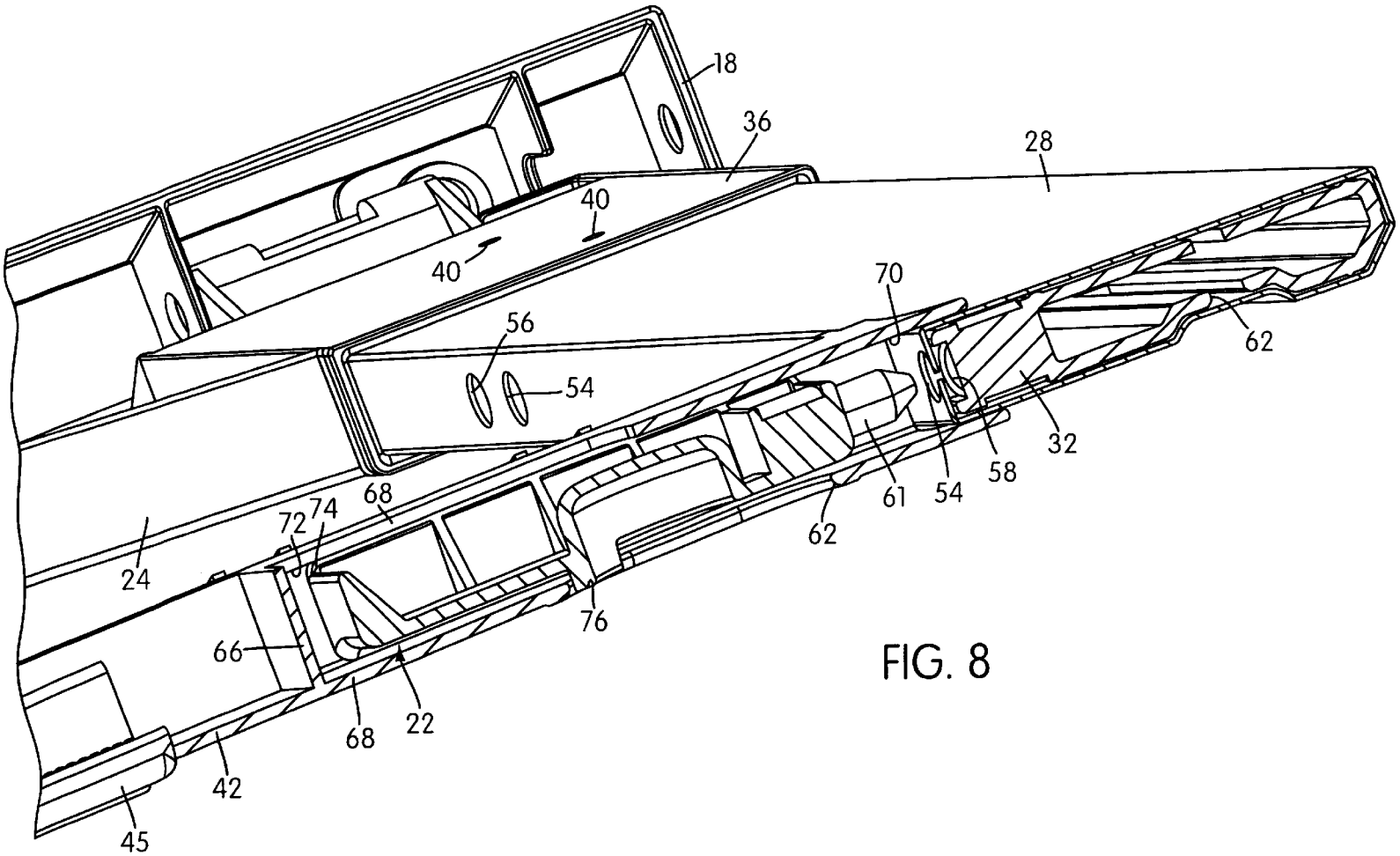
FIG. 8 is a cross-sectional view of the height adjustable sawhorse shown in FIG. 7, but showing the releasable locking member in its releasing position.

The upper leg members 28, 30 are of elongated hollow cross-sectional configuration sized with respect to a cooperating lower leg member 32, 34, respectively, so as to telescopically receive the same therein for relative rectilinear movement in opposite substantially vertical directions (FIGS. 7 and 8). As shown in FIGS. 2 and 3, the lower leg members 32, 34 have lower portions 50, 52, in the form of cantilevered foot portions, that are constructed and arranged to engage the horizontal support surface 19 for supporting the workpiece supporting structure 18 at a predetermined height above the horizontal support surface 19. The lower portions 50, 52 may be supplemented with anti-slip rubber insets (not shown) to prevent slippage of the sawhorse 10 when in use, or may themselves be formed of a non-slip material, such as rubber.

A securing structure 55 (FIG. 2) may be used to secure the lower portions 50, 52 to the lower leg members 32, 34. The securing structure 55 may be constituted by, for example, a protrusion projecting from the lower portions 50, 52 and received in a recess formed in the lower leg members 32, 34. Other forms of securing structure may be used as well, such as, fasteners, adhesives and press-fit engagements, for example.

As shown in FIG. 2, each lower leg member 32, 34 is mounted to an associated upper leg member 28, 30 for independent movement in a relative rectilinear vertical direction while the sawhorse 10 is in the operative position thereof. This construction enables a user to extend or retract one or more of the lower members 32, 34 independently relative to the upper leg members 28, 30 to readily adjust the height of the workpiece supporting surface 17 relative to the horizontal support surface 19 (FIG. 1). In this manner, the sawhorse 10 may be adjusted, for example, according to heights of different users or needs of a particular application. Additionally, the lower leg members 32, 34 may be adjusted individually to allow the angle and level of the workpiece supporting surface 17 to be adjusted relative to a level and/or contour of the horizontal support surface 19.

The fasteners 40 connecting the upper leg members 28, 30 and the downwardly extending end portions 44, 46 extend through the lower leg members 32, 34 to secure the lower leg members 32, 34 to the upper leg members 28, 30. The lower leg members 32, 34 can be adjusted to a plurality of different positions with respect to the associated upper leg member 28, 30 and the lower connecting member 42. Adjustment of the lower leg members 28, 30 is performed while the leg assemblies 12, 14 are retained in the operative position thereof by the connecting structure 20 in response to movement of the releasable locking member 22, as will be described in greater detail below.

FIG. 2 shows each lower leg member 32, 34 including stop structure in the form of a vertically elongated slot 62 formed through opposite sides (e.g., an exterior side and an interior side) thereof. The stop structure of the lower leg members 32, 34 engages the fasteners 40 associated with the upper leg members 28, 30. The fasteners 40 constitute cooperating stop structure to the vertically elongated slot 62. The vertically elongated slot 62 has a lower end 63 and an upper end 65 defined by end surfaces of the respective lower leg members 32, 34. The upper and lower ends 63, 65 of the vertical slot 62 cooperate with the fasteners 40 to limit the rectilinear movement of each lower leg member 32, 34 with respect to the respective upper leg member 28, 30. The upper end 63 of the elongated slot 62 limits downward movement while the lower end 65 in combination with the lower portions 50, 52 limits upward movement of each lower leg member 32, 34.

Figure 6:
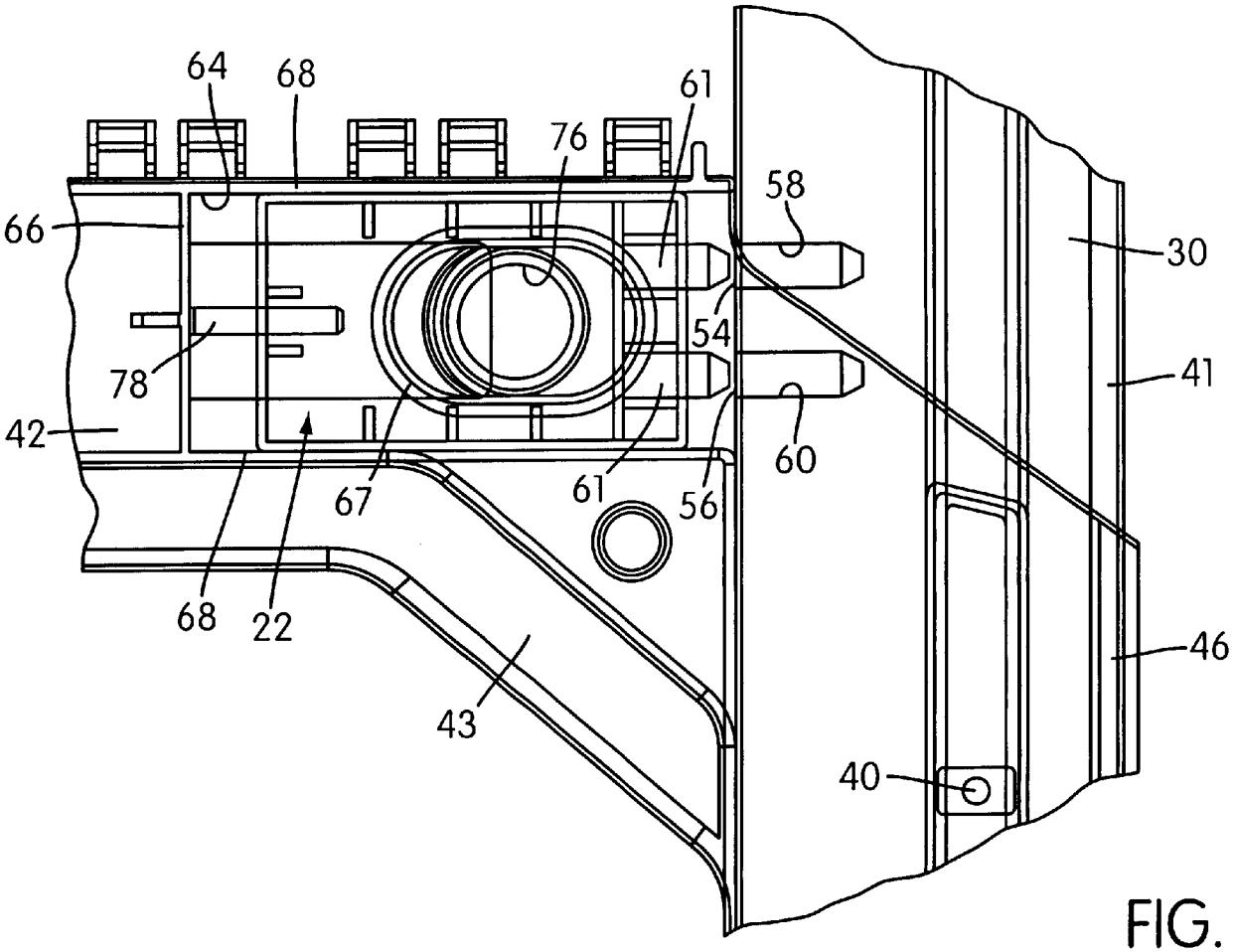
FIG. 6 is a detail view of a releasable locking member encircled in FIG. 5.

The upper leg members 28, 30 include a pair of openings 54, 56 formed on opposite ends thereof (openings 54, 56 are shown in FIG. 6). Similarly, the lower leg members 32, 34 include a series of openings 58, 60 (FIGS. 6–8) integrally formed therein. The openings 54, 56, 58, 60, (as shown in FIGS. 6–8) are constructed and arranged to accept and lockingly engage portions of the releasable locking member 22. The lockingly engaged portions of the releasable locking member 22 are provided by a pair of locking pins 61 positioned in the access openings 58, 60 of the lower connecting members 42. As discussed above, the upper leg members 28, 30 can have identical structure and the lower leg members 32, 34 can have identical structure for easy manufacture.

Each lower connecting member 42 includes a pair of opposing outwardly facing receptacles 64 formed therethrough within each of which one releasable locking member 22 for each upper leg member 28, 30 is mounted. Each lower connecting member 42 also includes a pair of exteriorly facing access openings 67 to allow manual operation of the releasable locking members 22. Each releasable locking member 22 is operable for movement between a releasing position and a locking position. In the releasing position, the releasable locking member 22 is operable to release an associated lower leg member 32, 34 from movement into a selected one of the plurality of adjusted positions thereof (as determined by the series of openings 58, 60 formed therein). In the locking position, the releasable locking member 22 is operable to lock the associated lower leg member 32, 34 within the adjusted position selected (where the locking pins 61 engage the openings 58, 60). Movement of each released lower leg member 32, 34 into a selected adjusted position while the pair of leg assemblies 12, 14 is retained in the operative position thereof by the connecting structure 20 allows the workpiece engaging structure 18 to be supported at different heights (selected by the user) above the horizontal support surface 19.

As shown in FIGS. 7 and 8, each receptacle region 64 is defined by an end wall 66 and a pair of oppositely facing side walls 68. The end wall 66 and side walls 68 of each receptacle region 64 are configured so that each receptacle region 64 has an open portion 70 facing the respective upper leg member 28, 30. The side walls 68 have a recess 72 formed therein, which is configured to slidably receive a flange portion 74 of the releasable locking member 22. Each releasable locking member 22 is slidably mounted in each receptacle region 64 to allow relative horizontal rectilinear movement of the releasable locking member 22. Alternatively, the side walls 68 can slidably engage the releasable locking member 22 without forming the recess 72 in the side walls 68.

The open portion 70 is positioned to align with the openings 54, 56 in the upper leg members 28, 30 and with the series of openings 58, 60 in the lower leg members 32, 34, respectively. In this manner, each releasable locking member 22 may slide within each receptacle region 64 to effect generally horizontal rectilinear movement through the open portion 70. In doing so, the locking pins 61 of the releasable locking member 22 can engage the openings 54, 56 in the upper leg members 28, 30 and can engage one of the series of openings 58, 60 in the lower leg members 32, 34 to support the workpiece engaging structure 18 at different heights (selected by the user) above the horizontal support surface 19.

The releasable locking member 22 includes a manually engageable portion 76, in the form of a circular portion or tab, that is manually engageable by a user through the access opening 67 to slide the releasable locking member 22 between its releasing and locking positions. A spring 78, as shown in FIG. 6, may be mounted between each releasable locking member 22 and each end wall 66 of the lower connecting structure 42 for biasing the locking pins 61 of the releasable locking member 22 toward and into the locking position thereof.

The height of the workpiece supporting structure 18 can, therefore, be easily adjusted by selectively adjusting the position of the lower leg members 32, 34 with respect to the upper leg members 28, 30. The lower leg members 28, 30 are normally placed in their lowermost position (FIG. 1, for example) when the sawhorse 10 is stored. To raise the position of the workpiece supporting structure 18, the user lifts the same, while standing on the lower portions 50, 52 and releasing a selected releasable locking member 22, for example, thereby causing the locking pins 61 of the selected releasable locking member 22 to move outwardly against the bias of the spring 78. When the locking pins 61 are released from the aligned openings 54, 56 and 58, 60, as shown in FIG. 6, rectilinear movement of the lower leg members 32, 34 with respect to the associated upper leg member 28, 30 is allowed. A user needs to release only one or more of the releasable locking members 22 at a time, or alternatively, may simultaneously release all of the releasable locking members 22, because the lower leg members 32, 34 may be independently extended and need not be extended at the same time.

It is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

For example, workers using sawhorses typically use power tools in conjunction therewith. It is therefore frequently necessary to have a source of electrical power at the work site where the sawhorses are being used. Electrical power is usually provided at a work site by electrical outlets and by electrically conductive extension cords. In alternative embodiments not shown, a plurality of attachments could be provided by the invention for use with the sawhorse 10 to mount an electrical power cord on the sawhorse 10 for power cord storage and used, for example. In other alternative embodiments not shown, a plurality of attachments could also provided by the invention to mount a power strip to the sawhorse 10 to provide a plurality of electrical outlets at the work site.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A sawhorse comprising:

an elongated workpiece supporting structure;

a pair of leg assemblies that support the workpiece supporting structure, said pair of leg assemblies being movable between a folded position for storage and transportation purposes and an operative position;

connecting structure connected with said leg assemblies below said workpiece supporting structure constructed and arranged to retain said leg assemblies in the operative position thereof and to allow movement of said leg assemblies between the operative and folded positions thereof;

each leg assembly including a pair of separate lower leg members having lower portions constructed and arranged to engage a horizontal support surface for the sawhorse when said pair of lower leg members are retained in the operative position by said connecting structure thereof so as to enable said workpiece supporting structure to be supported at a predetermined height above the horizontal support surface, each of said lower leg members being mounted for independent movement in a generally vertical direction and adjusted to a plurality of different positions with respect to the associated leg assembly and said connecting structure while the pair of said leg assemblies are retained in the operative position thereof by said connecting structure; and a releasable locking member associated with each lower leg member, wherein each releasable locking member is mounted in said connecting structure for movement between a releasing position wherein said releasable locking member is operable to release the associated lower leg member for movement into a selected one of the plurality of adjusted positions thereof and a locking position wherein said releasable locking member is operable to lock the associated lower leg member within the adjusted position selected.

2. The sawhorse of claim 1, wherein a spring is mounted between each releasable locking member and said connecting structure for biasing said releasable locking member toward and into the locking position thereof.

3. The sawhorse of claim 2, wherein each releasable locking member is mounted for generally horizontal rectilinear sliding movement in said connecting structure.

4. The sawhorse of claim 3, wherein each releasable locking member includes a manually engageable portion manually engageable by a user to slide said releasable locking member from the locking position thereof to the releasing position thereof against the bias of the associated spring and manually releasable to allow the spring to bias the releasable locking member from the releasing position for movement under the bias of said spring toward the locking position thereof.

5. The sawhorse of claim 2, wherein each leg assembly includes an upper connecting member pivoted to said workpiece supporting structure and a pair of spaced upper leg members fixed to said upper connecting member and extending generally downwardly therefrom when said leg assemblies are in the operative position thereof.

6. The sawhorse of claim 5, wherein each upper leg member is of elongated hollow cross-sectional configuration sized with respect to a cooperating lower leg member so as to telescopically receive the same therein for rectilinear movement in opposite directions.

7. The sawhorse of claim 6, wherein each upper and lower leg member is formed of metal.

8. The sawhorse of claim 7, wherein said upper connecting member and said connecting structure are formed from a plastic material.

9. The sawhorse of claim 6, wherein each lower leg member includes a cantilevered foot portion constructed and arranged to be engaged to assist in the movement of the lower leg member.

10. The sawhorse of claim 6, wherein said connecting structure includes a lower connecting member associated with each leg assembly connected with the upper leg members thereof and a foldable tray assembly pivotally connected between said lower connecting members.

11. The sawhorse of claim 10, wherein each lower leg member includes stop structure engageable with cooperating stop structure associated with the upper leg member telescopically receiving the same for limiting the rectilinear downward movement of each lower leg member.

12. The sawhorse of claim 1 wherein each lower leg member includes stop structure engageable with cooperating stop structure associated with the associated leg assembly for limiting the downward movement of said lower leg member and preventing the separation thereof from the associated leg assembly.

13. A sawhorse comprising:

an elongated workpiece supporting structure;

a pair of leg assemblies that support the workpiece supporting structure, said pair of leg assemblies being movable between a folded position for storage and transportation purposes and an operative position;

connecting structure connected with said leg assemblies below said workpiece supporting structure constructed and arranged to retain said leg assemblies in the operative position thereof and to allow movement of said leg assemblies between the operative and folded positions thereof;

each leg assembly including a pair of separate lower leg members having lower portions constructed and arranged to engage a horizontal support surface for the sawhorse when said pair of lower leg members are retained in the operative position by said connecting structure thereof so as to enable said workpiece supporting structure to be supported at a predetermined height above the horizontal support surface, each of said lower leg members being mounted for independent movement in a generally vertical direction and adjusted to a plurality of different positions with respect to the associated leg assembly and said connecting structure while the pair of said leg assemblies are retained in the operative position thereof by said connecting structure; and a releasable locking member for each lower leg member mounted in said connecting structure for movement between a releasing position wherein each said releasable locking member is operable to release the associated lower leg member for movement into a selected one of the plurality of adjusted positions thereof and a locking position wherein said releasable locking member is operable to lock the associated lower leg member within the adjusted position selected, wherein a spring is mounted between each releasable locking member and said connecting structure for biasing said releasable locking member toward and into the locking position thereof, wherein each leg assembly includes an upper connecting member pivoted to said workpiece supporting structure and a pair of spaced upper leg members fixed to said upper connecting member and extending generally downwardly therefrom when said leg assemblies are in the operative position thereof, wherein each upper leg member is of elongated hollow cross-sectional configuration sized with respect to a cooperating lower leg member so as to telescopically receive the same therein for rectilinear movement in opposite directions, wherein said connecting structure includes a lower connecting member associated with each leg assembly connected with the upper leg members thereof and a foldable tray assembly pivotally connected between said lower connecting members, wherein each lower leg member includes stop structure engageable with cooperating stop structure associated with the upper leg member telescopically receiving the same for limiting the rectilinear downward movement of each lower leg member, and wherein each lower connecting member is connected with each associated upper leg member by an end portion of said lower connecting member of elongated hollow cross sectional configuration sized to receive therein a lower portion of the associated upper leg member and a fastener fixedly connecting said end portion with said lower portion.

14. The sawhorse of claim 13, wherein the stop structure of each lower leg member comprises an end surface defining an upper end of a vertically elongated slot formed in said lower leg member.

15. The sawhorse of claim 14, wherein the fastener associated with each upper leg member extends through the slot in the associated lower leg member to constitute the cooperating stop structure for engaging the stop structure defined by the end surfaces of said slot.

16. The sawhorse of claim 15, each releasable locking member is mounted for generally horizontal rectilinear sliding movement in said connecting structure.

17. The sawhorse of claim 16, wherein each releasable locking member includes a manually engageable portion manually engageable by a user to slide said releasable locking member from the locking position thereof to the releasing position thereof against the bias of the associated spring and manually releasable to allow the spring to bias the releasable locking member from the releasing position for movement under the bias of said spring toward the locking position thereof.

18. A sawhorse comprising:

an elongated workpiece supporting structure;

a pair of leg assemblies that support the workpiece supporting structure, said pair of leg assemblies being movable between a folded position for storage and transportation purposes and an operative position;

connecting structure connected with said leg assemblies below said workpiece supporting structure constructed and arranged to retain said leg assemblies in the operative position thereof and to allow movement of said leg assemblies between the operative and folded positions thereof;

each leg assembly including a pair of separate lower leg members having lower portions constructed and arranged to engage a horizontal support surface for the sawhorse when said pair of lower leg members are retained in the operative position by said connecting structure thereof so as to enable said workpiece supporting structure to be supported at a predetermined height above the horizontal support surface, each of said lower leg members being mounted for independent movement in a generally vertical direction and adjusted to a plurality of different positions with respect to the associated leg assembly and said connecting structure while the pair of said leg assemblies are retained in the operative position thereof by said connecting structure; and a releasable locking member associated with each lower leg member, wherein each releasable locking member is accessible through said connecting structure and mounted thereto for movement between a releasing position wherein said releasable locking member is operable to release the associated lower leg member for movement into a selected one of the plurality of adjusted positions thereof and a locking position wherein said releasable locking member is operable to lock the associated lower leg member within the adjusted position selected, said locking member being spring biased into said locking position thereof.

* * * * *